US008734691B1

(12) United States Patent
Boeshart

(10) Patent No.: US 8,734,691 B1
(45) Date of Patent: May 27, 2014

(54) METHOD FOR CONSTRUCTING SITE-CAST OR PRECAST CONCRETE FLOORS, DECKS, ROOFS AND WALLS USING FOAM PANELS AS FORMS AND WOODEN JOISTS

(76) Inventor: Patrick E. Boeshart, Sioux City, IA (US)

( * ) Notice: Subject to any disclaimer, the term of this patent is extended or adjusted under 35 U.S.C. 154(b) by 247 days.

(21) Appl. No.: 13/210,647

(22) Filed: Aug. 16, 2011

(51) Int. Cl.
*E04B 1/16* (2006.01)
*E04C 2/288* (2006.01)

(52) U.S. Cl.
USPC ..... 264/35; 264/333

(58) Field of Classification Search
USPC ..... 264/333, 35
See application file for complete search history.

(56) References Cited

U.S. PATENT DOCUMENTS 3,401,494 A * 9/1968 Anderson ..... 52/309.2
4,856,244 A * 8/1989 Clapp ..... 52/309.7
5,333,429 A * 8/1994 Cretti ..... 52/309.7
6,272,749 B1 * 8/2001 Boeshart et al. ..... 29/897.32
6,817,150 B1 11/2004 Boeshart
2008/0041004 A1 * 2/2008 Gibbar et al. ..... 52/309.12

OTHER PUBLICATIONS 4-page brochure entitled "Lite-Deck Concrete Deck/Floor—Basic Installation Guide—Details for Builders and Designers"—by Lite-Form Technologies Dated: Oct. 2002 Amended Submission.

* cited by examiner

*Primary Examiner* — Christina Johnson
*Assistant Examiner* — Patrick Butler
(74) *Attorney, Agent, or Firm* — Sturm & Fix LLP

(57) ABSTRACT

A method for constructing site-cast or precast concrete floors, roofs and decks by first forming one piece elongated foam forms having an elongated cavity for reception of concrete. A pair of elongated slots is formed along the bottom of each of the forms. Wooden members are placed into each of the elongated slots to form an assembled combination of the foam form and wood members. A plurality of the assembled combinations are placed in juxtaposition with respect to each adjacent assembled combination on a support surface, rebar is placed in the cavity of each assembled combination and then concrete in an uncured form if poured over the assembled combinations and into the cavities of the forms so that once the concrete has cured a concrete panel has been formed.

23 Claims, 12 Drawing Sheets

Fig. 1
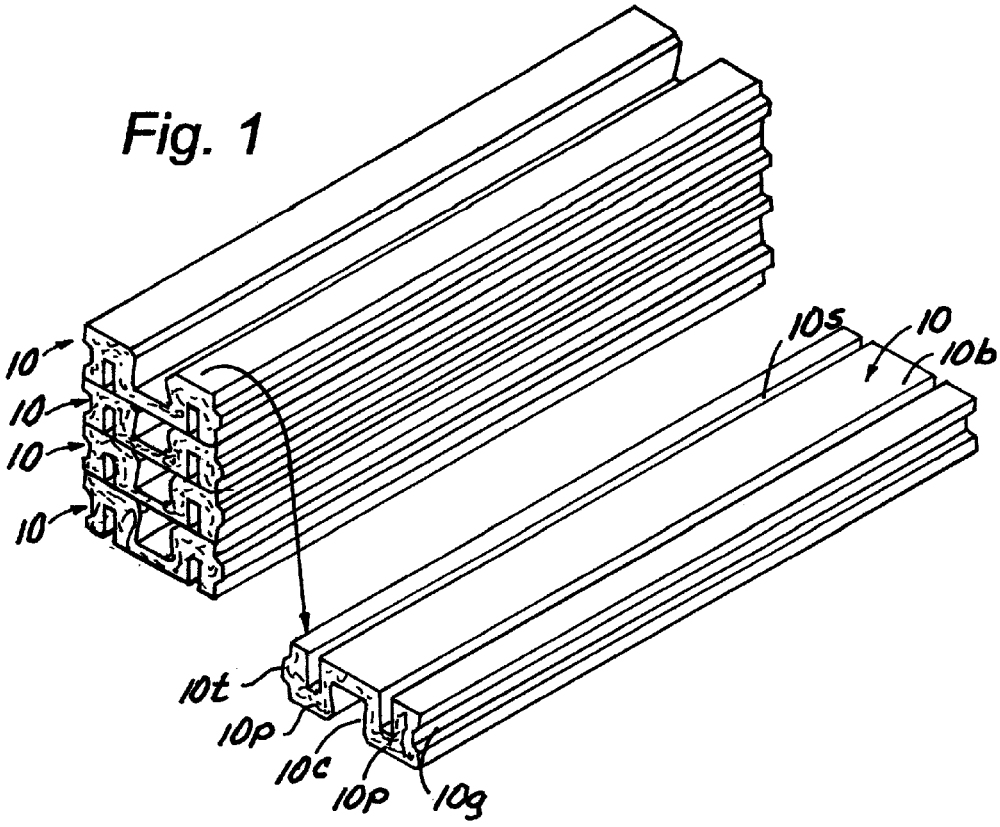
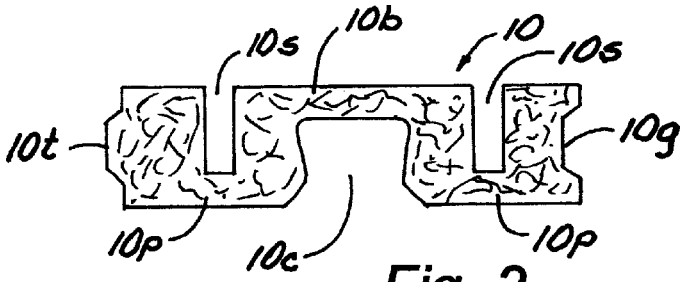
Fig. 2

TYPICAL PANEL CUTTING
AND REINFORCING RIBS
FOR CONCRETE SLABS

TYPICAL PANEL CUTTING
AND REINFORCING RIBS
SOME RIBS REMOVED AND
CUT FOAM PUT BACK FOR
ADDED INSULATION

Remove 2 x 6 wood
ribs in foam and reinstall
foam cut-outs as shown
for tight fit.

OPTIONAL NAILING
OF WOODEN RIBS
Fig. 17
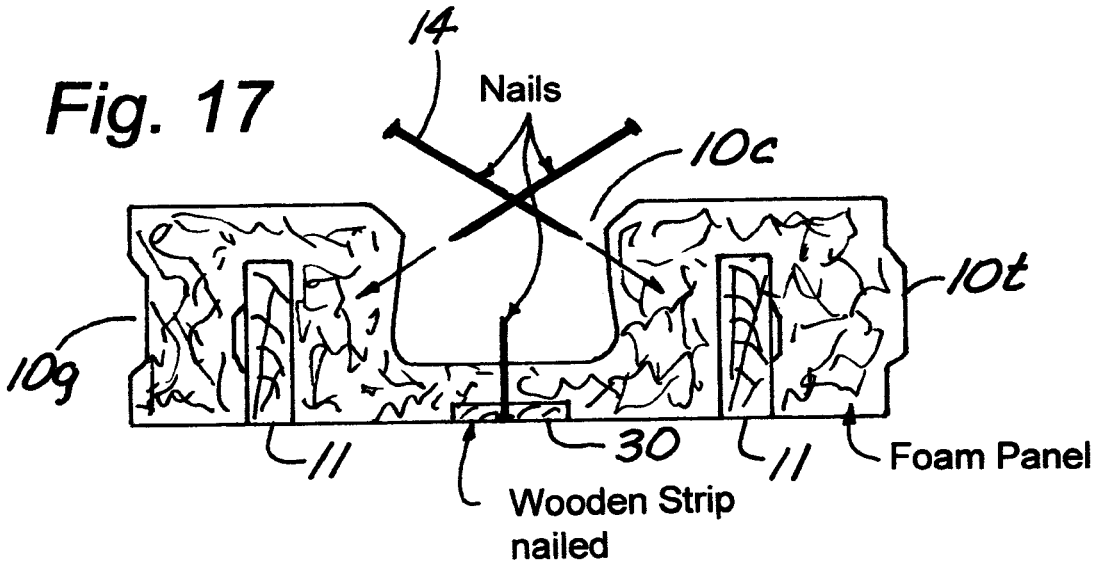
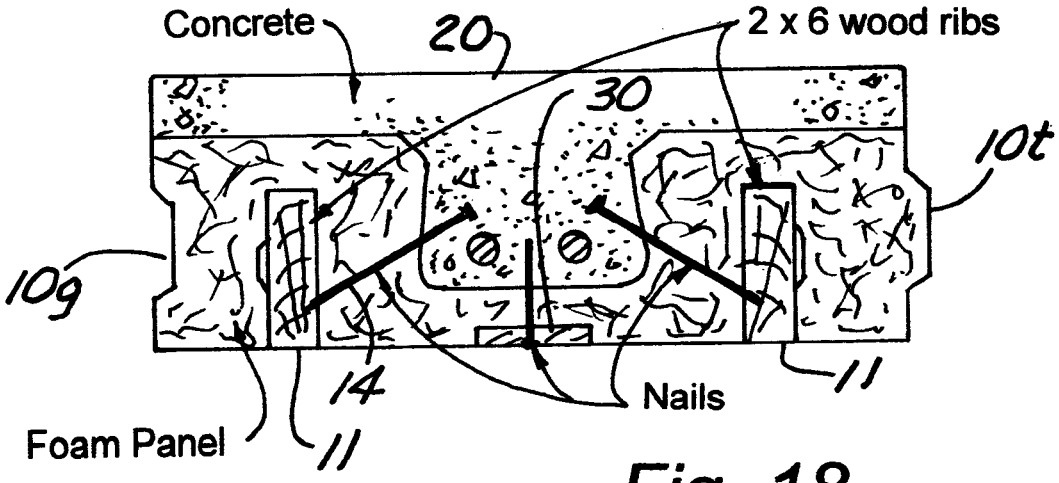
Fig. 18

OPTIONAL BEVEL
WOODEN STRIP
Fig. 19
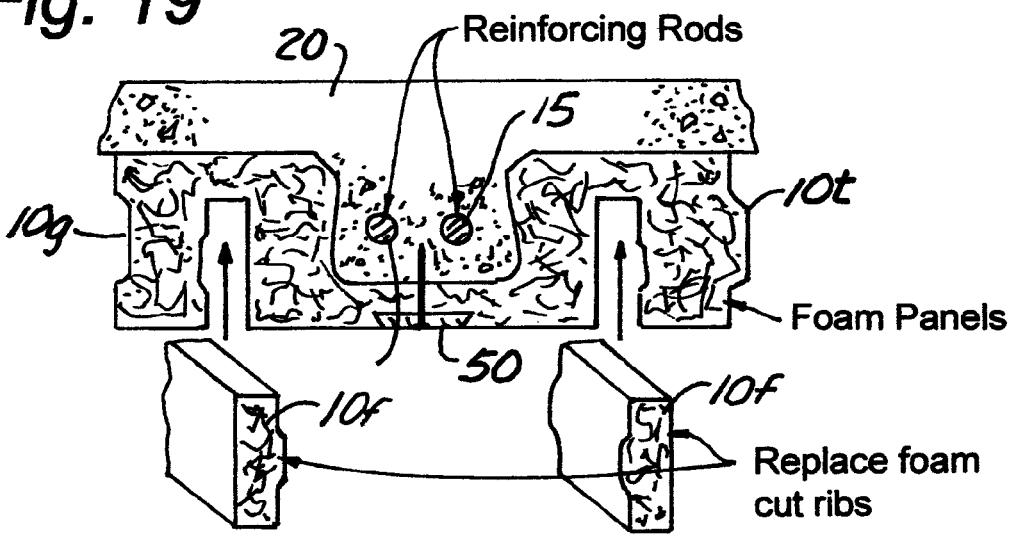
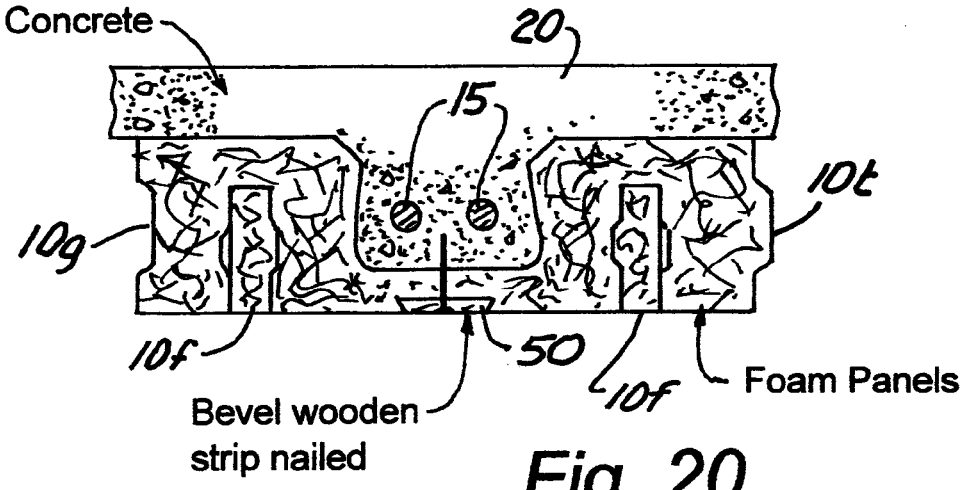
Fig. 20

Fig. 21
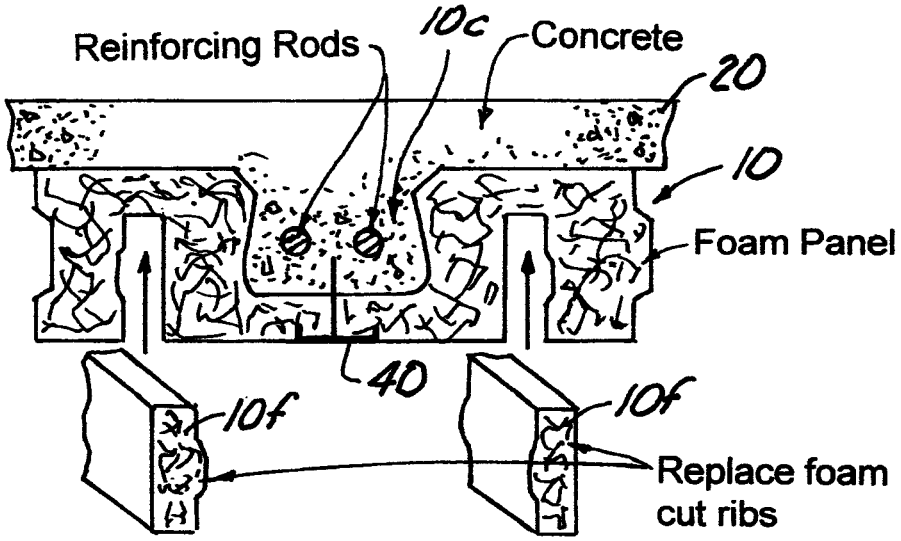
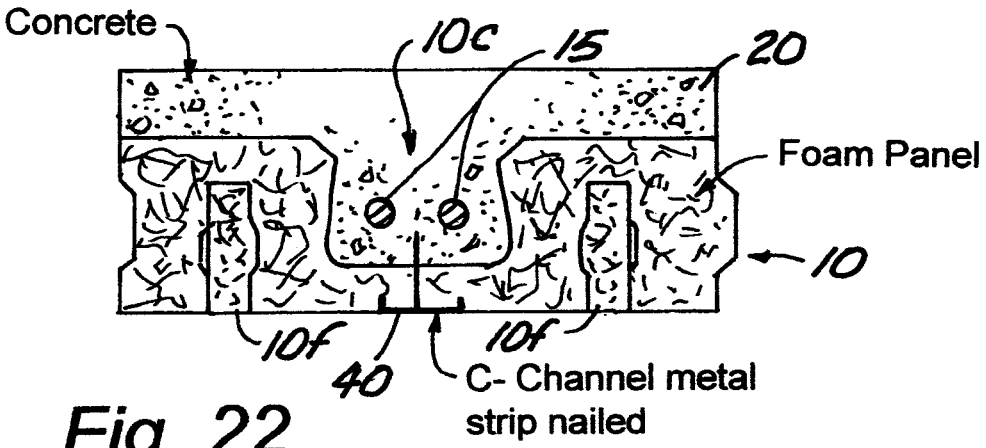
Fig. 22
OPTIONAL STEEL CHANNEL STRIP

METHOD FOR CONSTRUCTING SITE-CAST OR PRECAST CONCRETE FLOORS, DECKS, ROOFS AND WALLS USING FOAM PANELS AS FORMS AND WOODEN JOISTS

FIELD OF TECHNOLOGY

The present invention relates generally to a method and apparatus for constructing site-cast or precast concrete floors, decks, walls or roofs using expanded polystyrene foam as forms; and more particularly to using wooden joists embedded in the foam forms during in this process.

BACKGROUND

While wall forming systems have been in use for many years, the last two decades has seen considerable development in this industry in the use of expanded polystyrene panels as forms for poured concrete walls, decks, floors or roofs.

A Lite-Deck SRS™ brand system in the prior art uses steel C-channel ribs embedded into foam forms to permit the creation of large clear-spans for floors, roofs, decks and tilt-up applications. This formwork is manufactured to job specific specifications and is available in forty plus foot lengths. The steel ribs can be cut out and removed after placement of concrete for re-use.

The residential construction industry has historically used wooden joists or the like instead of using steel joists and therefore has not fully accepted the use of steel joists like those used in the Lite-Deck SRS™ brand system mentioned above. Accordingly there is a need for being able to obtain the benefits of the Lite-Deck SRS™ brand system without using the required steel ribs of that system.

SUMMARY

The present invention relates to a method for constructing site-cast or precast concrete floors, roofs and decks by first forming one piece elongated foam forms having a first pier and a second pier, the first pier and second pier being connected together at the bottom thereof and having a space between the first and second piers thereby forming an elongated cavity for reception of concrete in an uncured form. An elongated slot of a predetermined cross sectional shape is formed between the first and second piers along the bottom of each of the first and second piers along the length of the first and second piers. Wooden members of approximately the predetermined cross sectional shape are then placed into each of the elongated slots of the first and second piers to form an assembled combination of the foam form and wood members. A plurality of the assembled combinations are placed in juxtaposition with respect to each adjacent assembled combination on a support surface, rebar is placed in the cavity of each assembled combination and then concrete in an uncured form if poured over the assembled combinations and into the cavities of the forms so that once the concrete has cured a concrete panel has been formed.

BRIEF DESCRIPTION OF THE DRAWINGS

FIG. 1 is a perspective view of a preferred embodiment of foam panels used in the present invention and showing the top form being flipped over onto a support surface;

FIG. 2 is an end view of one of the foam panels;

FIG. 17 is a cross-sectional view of an alternate way to attach the wood joists to the foam forms and the foam form to an additional wooden strip at the lower center of each form using nails;

FIG. 18 is a view like FIG. 17, but showing concrete having been poured over the form and into the elongated cavity containing rebar;

FIG. 19 is a view like FIG. 15, but showing how once the wood joists are removed, as shown in FIG. 15, the foam pieces that were removed similar to the way it is shown in FIG. 13 where the wood joists are replaced, the foam pieces again, preferably being flipped over to make them fit tighter, FIG. 19 using a dovetailed shaped piece of wood at the bottom center of the foam form instead of a rectangular in cross-section shaped piece of wood as shown in the embodiment of FIGS. 17 and 18;

FIG. 20 is a view showing foam pieces being reinserted from the way they were removed as shown in FIG. 19;

FIG. 21 is a view like FIG. 19, but showing concrete having been poured over the form and into the elongated cavity containing rebar;

FIG. 22 is a view like FIG. 15, but showing how once the wood joists are removed, as shown in FIG. 15, the foam pieces that were removed similar to the way it is shown in FIG. 13 where the wood joists are replaced, the foam pieces again, preferably being flipped over to make them fit tighter, FIGS. 21 and 22 using a C-channel shaped piece of steel at the bottom center of the foam form instead of a rectangular in cross-section shaped piece of wood as shown in the embodiment of FIGS. 17 and 18;

DETAILED DESCRIPTION OF THE INVENTION

Figure 3:
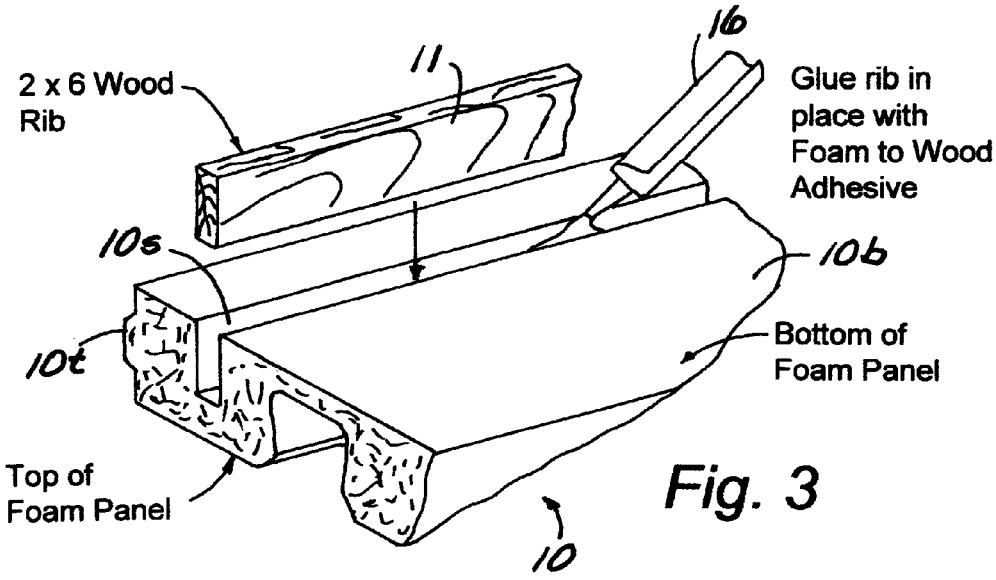
FIG. 3 is a perspective view of one of the panels like that shown in FIG. 2, with wood joints being placed in slots in the panels and attached optionally by an adhesive.
Figure 4:
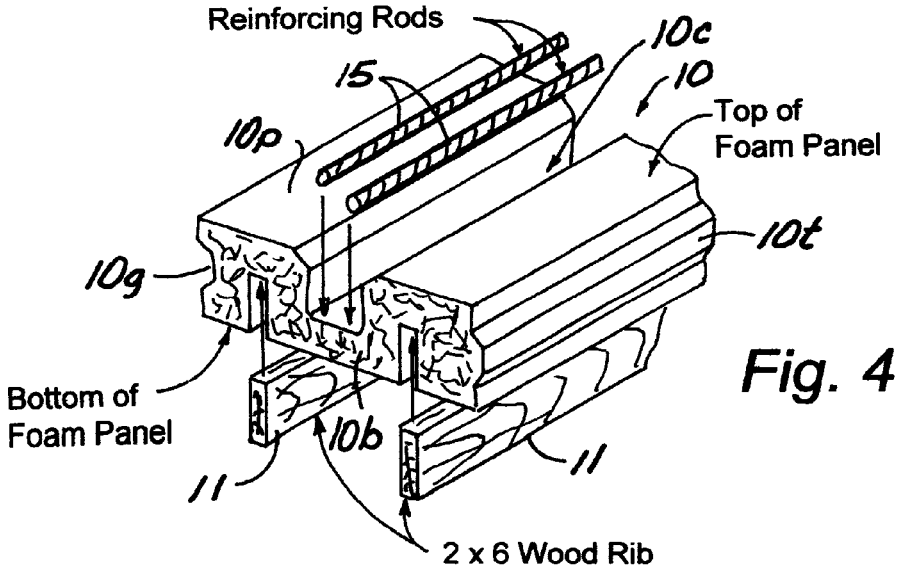
FIG. 4 is a perspective view like FIG. 3, but flipped over and showing how steel rebar is placed in an elongated cavity in one of the forms and wood joists are placed in slots in the bottom of each pier of each form.
Figure 5:
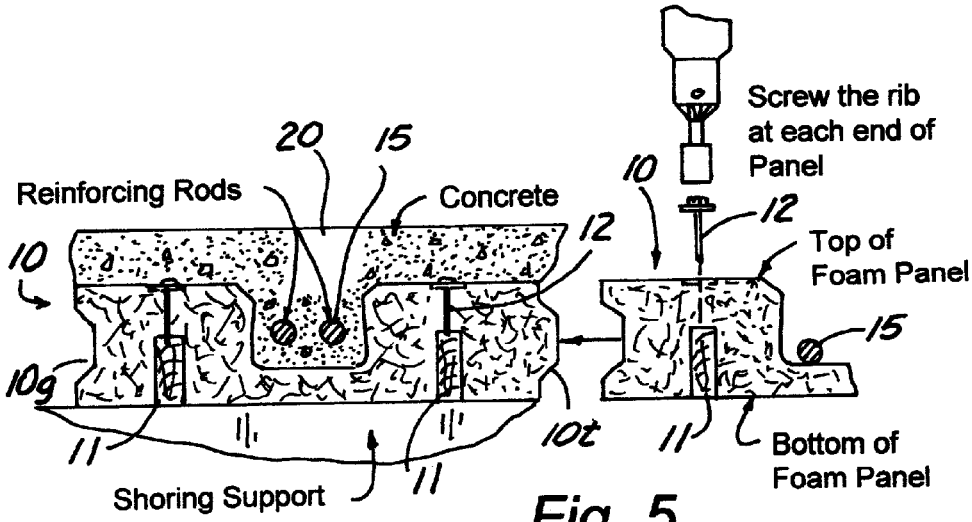
FIG. 5 is a cross-sectional view of the foam panel structure shown in FIG. 4, after screws are used to attach the piers to the wood joists and concrete is poured over the top of the form, filling the elongated cavity and covering the top of each pier and also showing how the foam forms nest against each other.

Referring now to the drawings wherein like reference numerals designate identical or corresponding parts throughout the several views, FIG. 1 shows a perspective view of a plurality of the main structural elements, foam panels 10, of the embodiment of the present invention, with the top panel 10 being flipped over to begin the process shown graphically in FIGS. 3-5. These foam panels/forms 10 are preferably made of expanded polystyrene foam. The foam panels 10 have a tongue portion 10*t* on one edge and a slot portion 10*g* on the other edge thereof for mating with one another.

Looking to FIG. 4 because the form 10 is shown in the orientation in which concrete is poured onto it, two piers, 10*p* are shown forming an elongated cavity 10*c* between them. Elongated slots 10*s* are formed in the bottom of each pier 10*p*, preferably by using hot wires to cut the slots 10*s* out as will be explained below.

The present invention relates to a method for constructing site-cast or precast concrete floors, roofs and decks by first forming the piece elongated foam forms 10 having a first pier 10*p* and a second pier 10*p*, the first pier 10*p* and second pier 10*p* being connected together at the bottom thereof by foam part 10*b* forming a space between the first and second piers 10*p* thereby forming an elongated cavity 10*c* for reception of concrete 20 in an uncured form.

The elongated slot 10*s* is sized to be of a predetermined cross sectional shape in the first and second piers 10*p* along the bottom of each of the first and second piers 10*p* along the length of the first and second piers 10*p*, for example to be of a size that standard nominal 2"×6" lumber available locally virtually anywhere in the United States would fit into the slots 10*s*.

Looking to FIGS. 3 and 4, wood members 11 of approximately the predetermined cross sectional shape are placed into each of the elongated slots 10*s* of the first and second piers 10*p* to form an assembled combination of the foam form and wood members 11 as shown in FIG. 5. These wood members 11, such as standard nominal 2"×6" lumber, can be glued into the elongated slots 10*s* with a glue gun 16 as shown in FIG. 3, fastened with threaded fasteners 12 as shown in FIG. 5, or attached with nails 14 as shown in FIGS. 17 and 18. Or the wood members 11 can just be placed into the elongated slots 10*s* without fastening them to the foam form 10, especially if it is desired to later remove them as will be discussed below.

Figure 25:
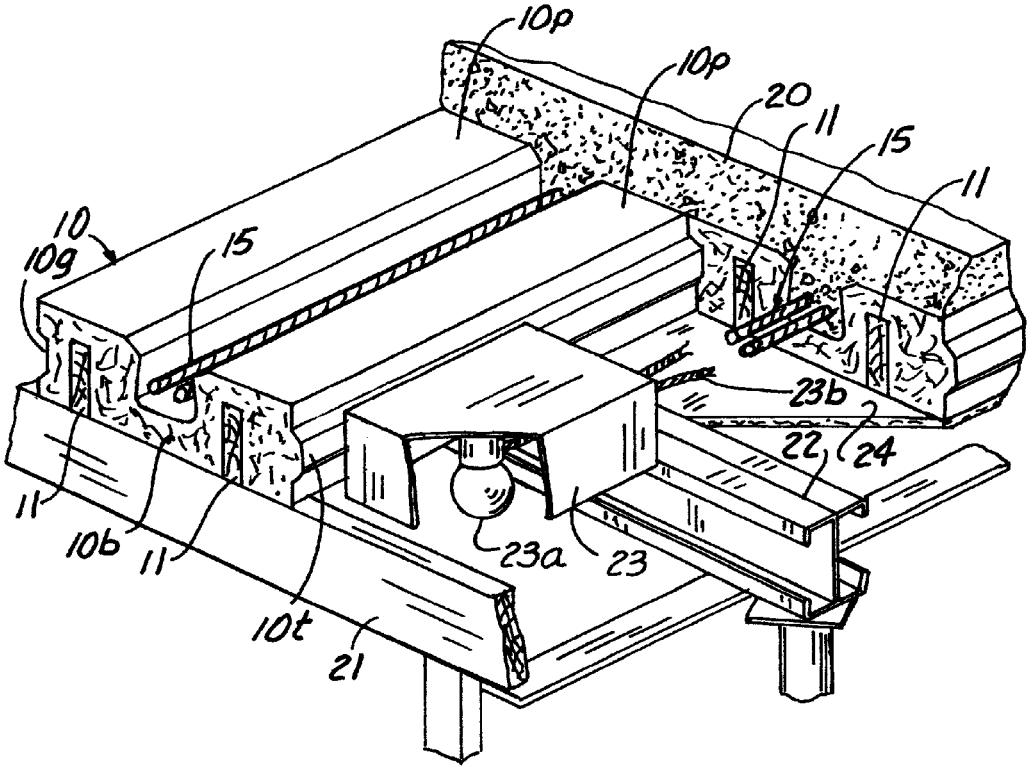
FIG. 25 is a perspective view of the embodiment of FIGS. 1-6 shown supported on top of beams for example to construct a deck on a building, with parts broken away to show the foam forms with rebar and wood joists in place and how electrical wires can be attached to the wood joists and how sheeting such as finishing plywood can be attached to the bottom of the concrete/foam/wood panel by fasteners (not shown) attached to the wood joists.

A plurality of the assembled combinations, for example as shown in FIG. 25, are placed in juxtaposition with respect to each adjacent assembled combination on a support surface, like support members 21 and 22 in FIG. 25.

One or more steel rebar members 15 are then placed in the cavity 10*s* as shown in FIGS. 5 and 25, for example. Lighting fixtures such as lighting fixture 23, with light bulb 23*a* and electrical wiring 23*b* can be placed in advance of pouring of concrete 20, or the wiring 23*b* can be attached to joists 11 after the concrete 20 has been poured. One of the last steps is pouring concrete in an uncured form over the assembled combinations of forms 10 and into the cavities of the forms; and allowing the concrete to cure to thereby form a concrete panel as shown in FIGS. 5 and 25. FIG. 25 shows also that a finishing sheet(s) 24, such as plywood, can be attached to the underside of the completed assembled combination, for example under an elevated deck of a home. The finishing sheet can be nailed or screwed to the joists 11 or can be held in place by an adhesive.

Figure 6:
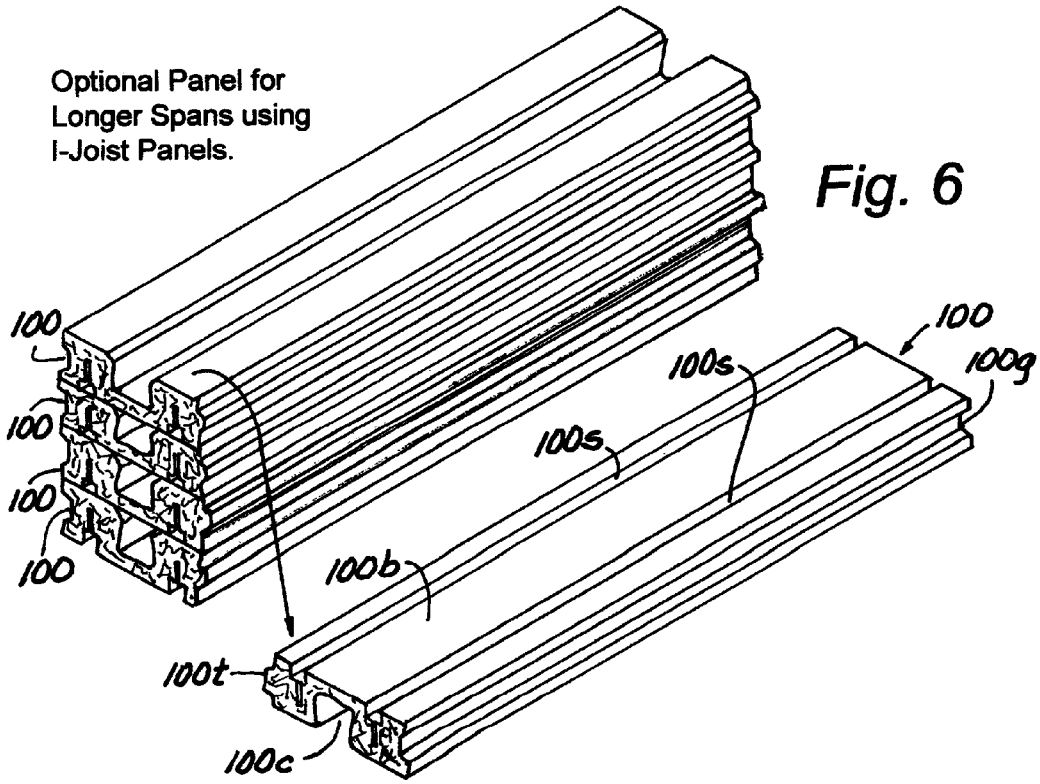
FIG. 6 is a perspective view of a second preferred embodiment of foam panels used in the present invention and showing the top form being flipped over onto a support surface as in FIG. 1, the difference being that the foam form has a slots of a shape to accept one half of an I-Joist that has been cut in two pieces as shown in FIG. 7.

FIG. 6-11 show another embodiment of the invention which is essentially identical to the embodiment of FIGS. 1-5, except that I-Joints are used instead of rectangular in cross-section shaped lumber as joints, like joists 11 in FIGS. 2-5. FIG. 6 shows a perspective view of a plurality of the main structural elements, foam panels 100, of the embodiment of the present invention, with the top panel 100 being flipped over to begin the process shown graphically in FIGS. 8-11. These foam panels/forms 100 are preferably made of expanded polystyrene foam. The foam panels 100 have a tongue portion 100*t* on one edge and a groove portion 100*g* on the other edge thereof for mating with one another.

Figure 7:
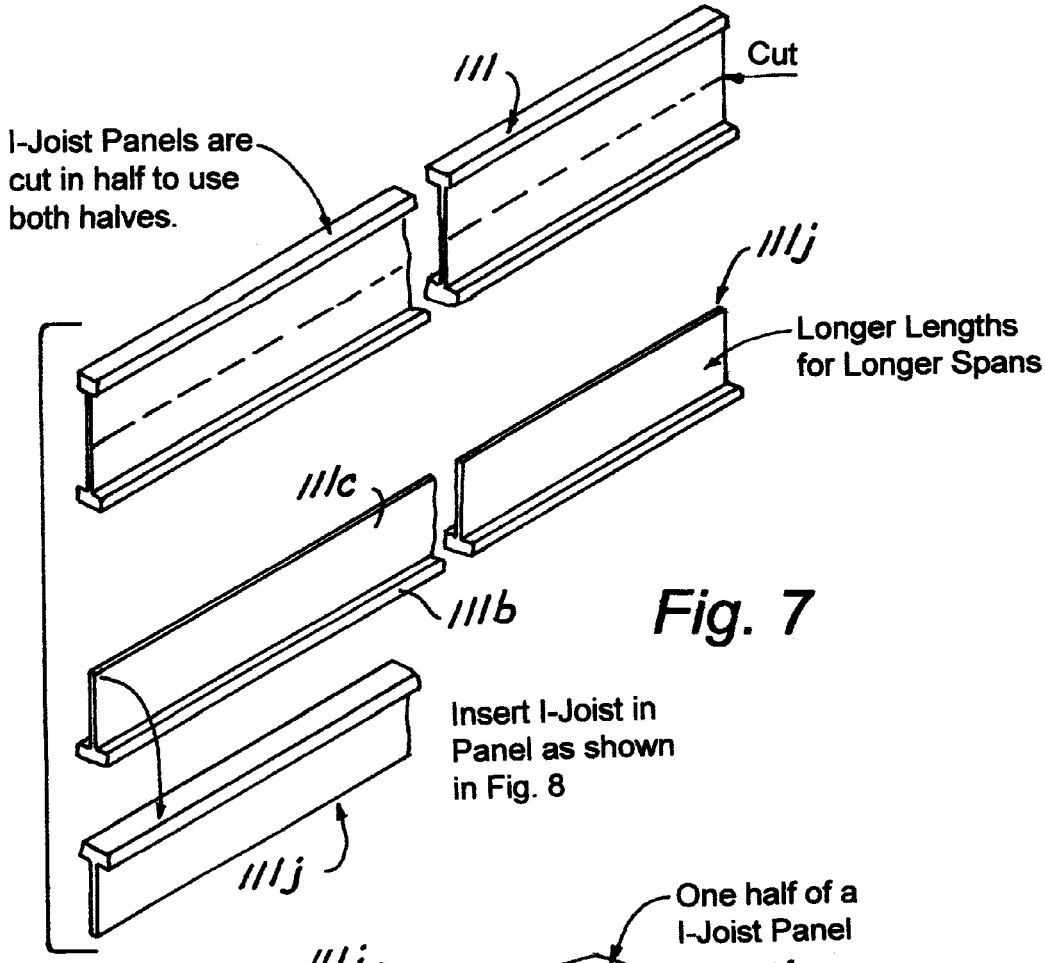
FIG. 7 is a perspective view of an I-Joist that is being cut in half to produce a component for use with the present invention with both halves.

Looking to FIG. 7 is it can be seen that I-joists 111 are cut in two along the dotted line to form joists 111*j*.

Figure 10:
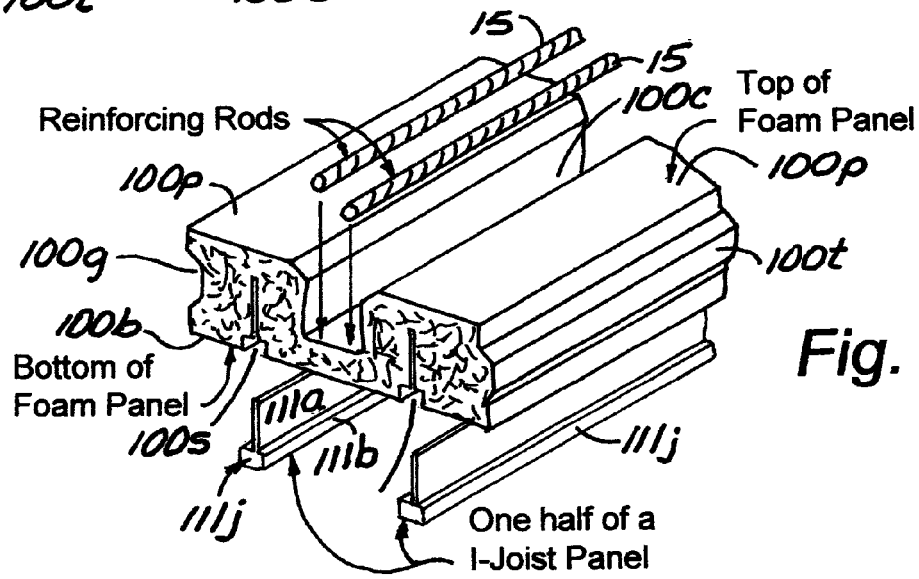
FIG. 10 is a perspective view like FIG. 3, showing how steel rebar is placed in an elongated cavity in one of the forms and half of a wood I-Joists are placed in slots in the bottom of each pier of the form.

Looking to FIG. 10 because the form 100 is shown in the orientation in which concrete is poured onto it, two piers, 100*p* are shown forming an elongated cavity 100*c* between them. Elongated slots 110*s* are formed in the bottom of each pier 100*p*, preferably by using hot wires to cut the slots 100*s* out as will be explained below.

The method for constructing site-cast or precast concrete floors, roofs and decks, except for the shape of the slots 100*s* and the shape of the joists 111*j*, is the same as the process explained above for the embodiment of FIGS. 1-5 and 25. By first forming the piece elongated foam forms 100 having a first pier 100*p* and a second pier 100*p*, the first pier 100*p* and second pier 100*p* are connected together at the bottom thereof by foam part 100*b* forming a space between the first and second piers 100*p* thereby forming an elongated cavity 100*c* for reception of concrete 20 in an uncured form.

The elongated slot 100*s* is sized to be of a predetermined cross sectional shape in the first and second piers 100*p* along the bottom of each of the first and second piers 100*p* along the length of the first and second piers 100*p*, for example to be of a size that standard half of an I-Joist 111*j*, complete I-Joists 111 being available locally virtually anywhere in the United States would fit into the slots 100*s*.

Figure 8:
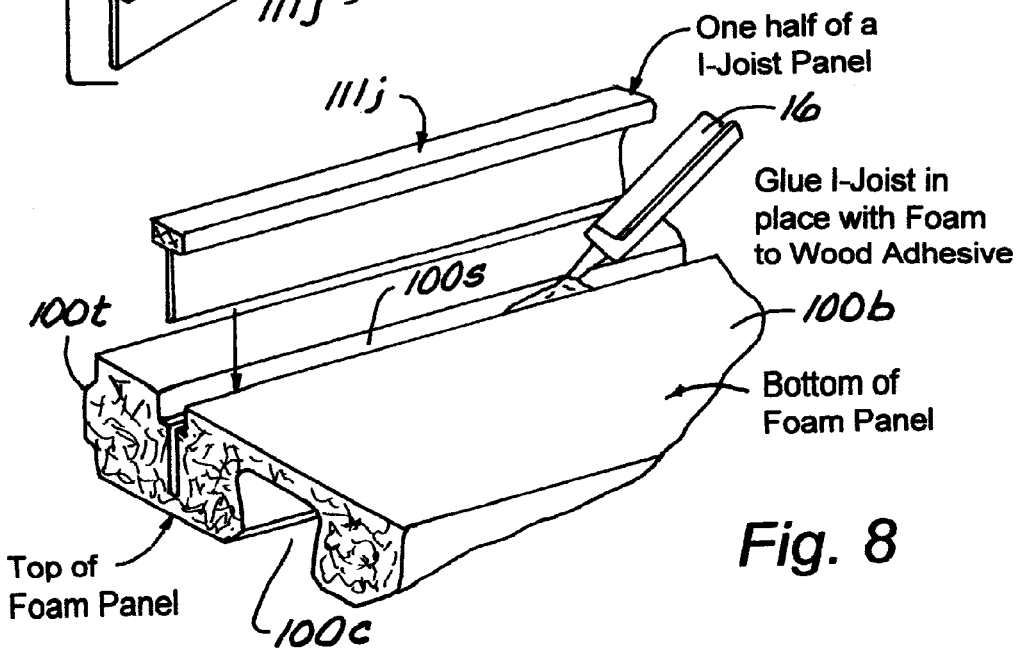
FIG. 8 is a perspective view like FIG. 3, with one half of the I-Joist made in FIG. 7 being placed in slots in the panels and attached optionally by an adhesive.
Figure 9:
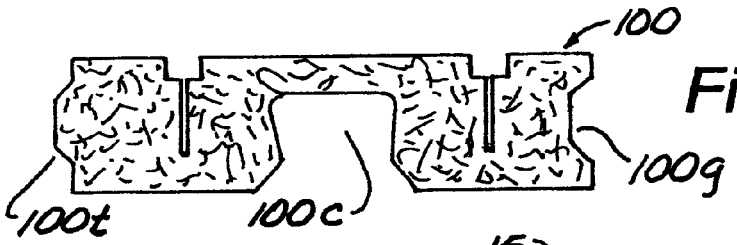
FIG. 9 is an end view of one of the panels of FIG. 8.
Figure 11:
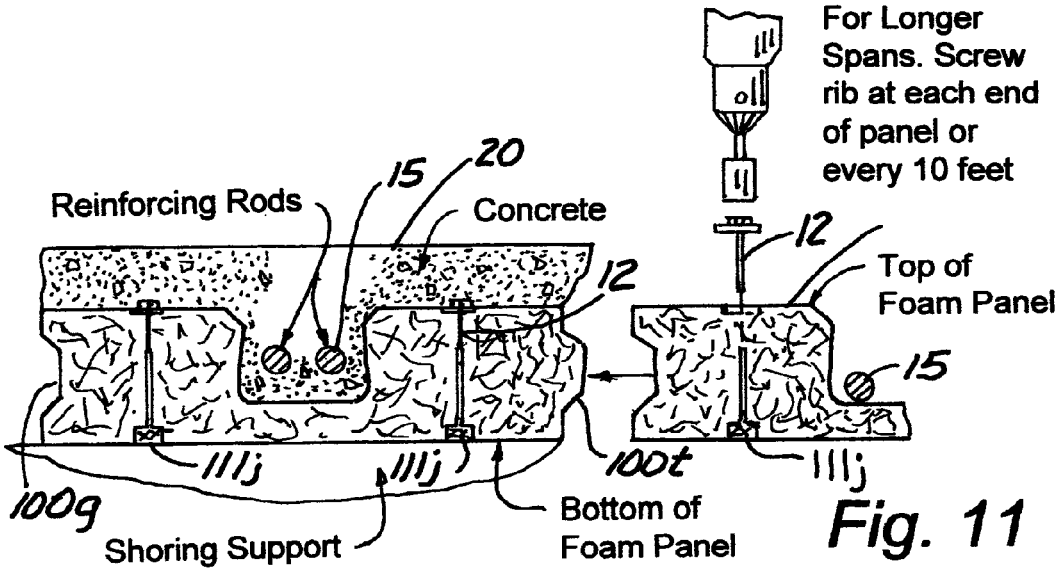
FIG. 11 is a cross-sectional view of the foam panel structure shown in FIG. 10, after screws are used to attach the piers to the wood joists and concrete is poured over the top of the form, filling the elongated cavity and covering the top of each pier and also showing how the foam forms nest against each other.

Looking to FIGS. 8-10, joists 111*j* of approximately the predetermined cross sectional shape are placed into each of the elongated slots 100*s* of the first and second piers 100*p* to form an assembled combination of the foam form and wood joists 111*j* as shown in FIG. 11. These joists 111*j* can be glued into the elongated slots 100*s* with a glue gun 16 as shown in FIG. 8, fastened with threaded fasteners 12 as shown in FIG. 11, or attached with nails 14 as shown in FIGS. 17 and 18. Or the joists 111*j* can just be placed into the elongated slots 100*s* without fastening them to the foam form 100, especially if it is desired to later remove them as will be discussed below.

A plurality of the assembled combinations could look like that shown in FIG. 25 (except it would have joists 111*j* instead of joists 11) placed in juxtaposition with respect to each adjacent assembled combination on a support surface, like support members 21 and 22 in FIG. 25, and having concrete 20 poured over the top and leveled off in a conventional fashion.

Figure 12:
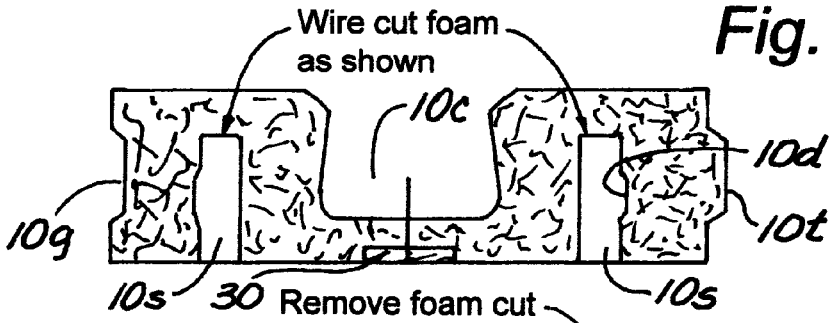
FIG. 12 is an end view of one of the foam forms shown in FIGS. 1-6, but showing more detail of how the elongated slots are cut from the bottom of each pier using hot wire.
Figure 13:
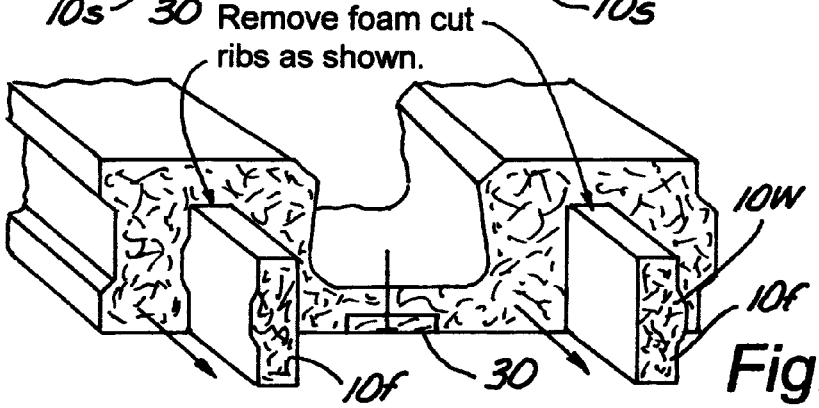
FIG. 13 is a perspective view showing how the foam pieces cut with the hot wire are removed.
Figure 14:
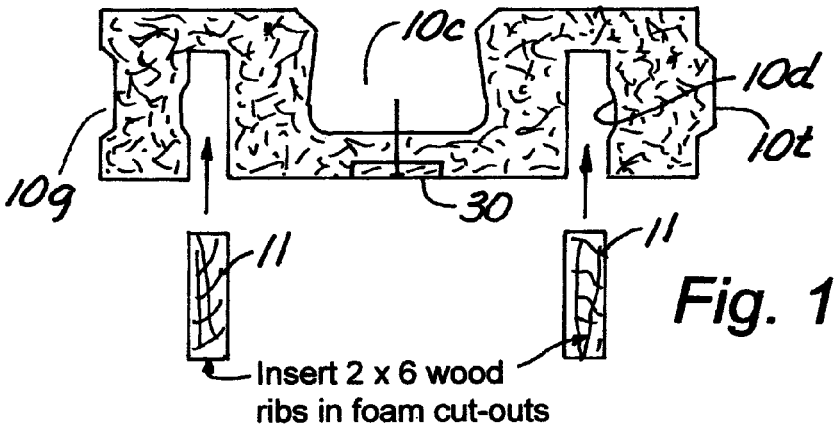
FIG. 14 is a perspective view like FIG. 13 but showing how wood joists are placed into the elongated slots where the foam pieces have been removed.

Looking to FIG. 12, one of the foam forms is shown like those in FIGS. 1-6, but showing more detail of how the elongated slots 11*s* are cut from the bottom of each pier 10 using hot wire, not shown. FIG. 13 is a perspective view showing how the foam pieces cut with the hot wire are removed. FIG. 14 is a perspective view like FIG. 13 but showing how wood joists 11 are placed into the elongated slots 10*s* where the foam pieces 10*f* have been removed.

Figure 15:
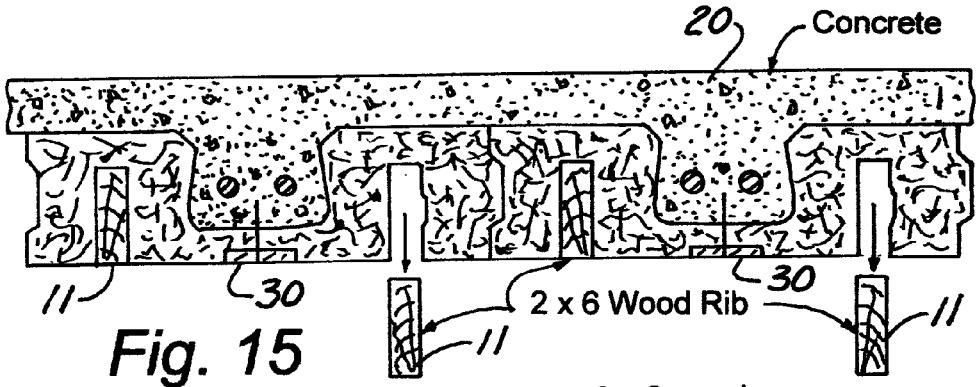
FIG. 15 is a cross sectional view like FIG. 5, but showing how every other wood joist is being removed for re-use after the concrete has been poured, though the sliding movement along the line of the arrow in FIG. 15 would instead often be into or out from the page if the wood joists have support member under them.
Figure 16:
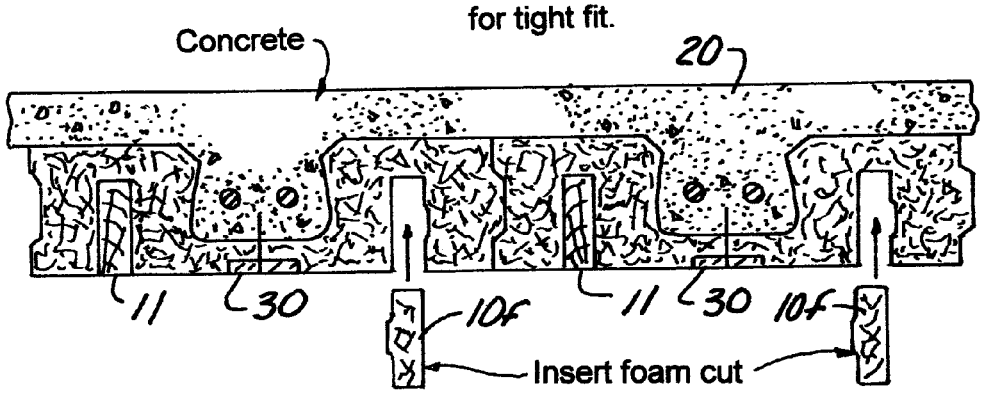
FIG. 16 is a view like FIG. 15, but showing how once the wood joists are removed, as shown in FIG. 15, the foam pieces that were removed as shown in FIG. 13 are replaced where the wood joists are replaced, except that the foam pieces are preferably flipped over to make them fit tighter due to the fact that the elongated protuberance on one side of each foam piece is now facing the flat side of the slot instead of the side of the slot with an elongated depression in the sidewall thereof.

Looking to FIG. 15, it is a cross sectional view like FIG. 5, but showing how every other wood joist 11 is being removed for re-use after the concrete 20 has been poured, though the sliding movement along the line of the arrow in FIG. 15 would instead often be into or out from the page if the wood joists 11 have support member under them. FIG. 16 is a view like FIG. 15, but showing how once the wood joists 11 are removed, as shown in FIG. 15, the foam pieces 10*f* that were removed as shown in FIG. 13 are replaced where the wood joists 11 are replaced, except that the foam pieces 10*f* are preferably flipped over to make them fit tighter due to the fact that the elongated protuberance 10*w* on one side of each foam piece 10*f* is now facing the flat side of the slot 10*s* instead of the side of the slot with an elongated depression 10*d* in the sidewall thereof. A rectangular in cross-section shaped piece of wood 30 as shown in the embodiment of FIGS. 12-14, 17 and 18 can be used to attach electrical wires or other things thereto after the concrete has been poured.

FIG. 19 is a view like FIG. 15, but showing how once the wood joists 11 are removed, as shown in FIG. 15, the foam pieces 10*f* that were removed similar to the way it is shown in FIG. 13 where the wood joists 11 are replaced, the foam pieces 10*f* again, preferably being flipped over to make them fit tighter, FIG. 19 using a dovetailed shaped piece of wood 50 at the bottom center of the foam form instead of a rectangular in cross-section shaped piece of wood 30 as shown in the embodiment of FIGS. 17 and 18. FIG. 20 is a view showing foam pieces 10*f* being reinserted from the way they were removed as shown in FIG. 19.

FIG. 21 is a view like FIG. 19, but showing concrete 20 having been poured over the form 10 and into the elongated cavity 10*c* containing rebar 15. FIG. 22 is a view like FIG. 15, but showing how once the wood joists 11 are removed, as shown in FIG. 15, the foam pieces 10*f* that were removed similar to the way it is shown in FIG. 13 where the wood joists 11 are replaced, the foam pieces 10*f* again, preferably being flipped over to make them fit tighter, FIGS. 21 and 22 using a C-channel shaped piece of steel 40 at the bottom center of the foam form 10 instead of a rectangular in cross-section shaped piece of wood 30 as shown in the embodiment of FIGS. 12-14, 17 and 18.

Figure 23:
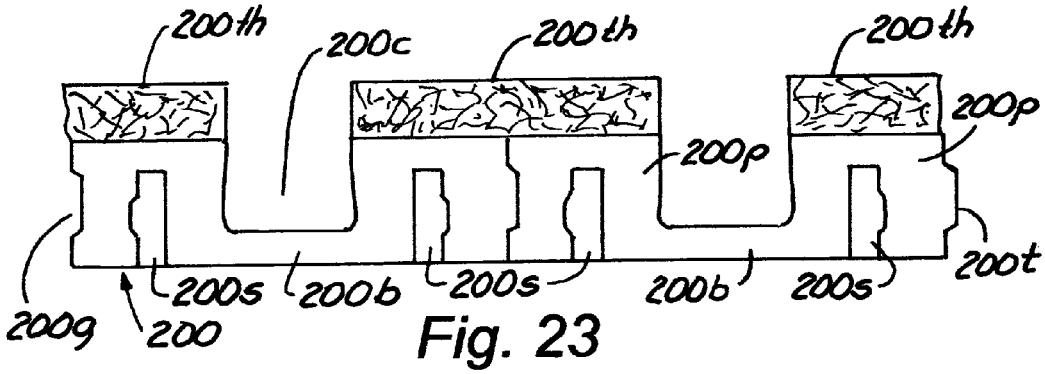
FIG. 23 is a side view of the foam form similar to the foam form of FIG. 5 but with a "top hat" on top of each pair of adjacent piers so as to make the elongated cavity between the piers and between the adjacent "top hats" deeper.

Looking now to FIG. 23, a side view of a foam form similar to the foam form of FIG. 5, shown but with a "top hat" 200*th* on top of each pair of adjacent piers 200*p* so as to make the elongated cavity 200*c* between the piers 200*p* and between the adjacent "top hats" 200*th* deeper.

Figure 24:
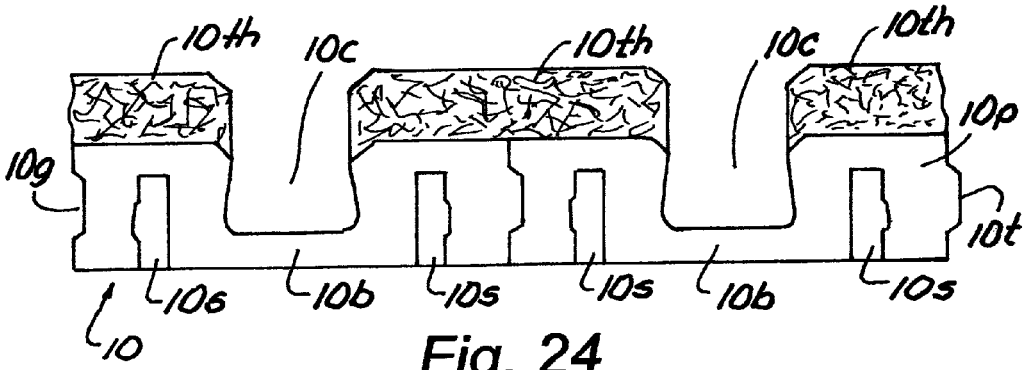
FIG. 24 is a side view of the foam form of FIG. 5 but with a "top hat" of a different configuration on top of each pair of adjacent piers so as to make the elongated cavity between the piers and between the adjacent "top hats" deeper.

FIG. 24 is a side view of the foam form 10 of FIG. 5 but with a "top hat" 10*th* of a different configuration on top of each pair of adjacent piers 10*p* so as to make the elongated cavity 10*c* between the piers 10*p* and between the adjacent "top hats" 10*th* deeper. U.S. Pat. No. 6,817,150 to Boeshart shows the basic idea of top hats for foam forms and therefore is incorporated herein by reference in its entirety.

Obviously many modifications and variations of the present invention are possible in light of the above teachings. It is therefore to be understood that, within the scope of the appended claims, the invention may be practiced otherwise than as specifically described.

I claim:

1. A method for constructing site-cast or precast concrete floors, roofs and decks, the method comprising:

forming one piece elongated foam forms having a first pier and a second pier, the first pier and second pier being connected together at the bottom thereof and having a space between the first and second piers thereby forming an elongated cavity for reception of concrete in an uncured form;

forming an elongated slot of a predetermined cross sectional shape in the first and second piers along the bottom of each of the first and second piers along the length of the first and second piers;

placing a wood member of approximately said predetermined cross sectional shape into each of the elongated slots of the first and second piers to form an assembled combination of the foam form and wood members;

placing a plurality of the assembled combinations in juxtaposition with respect to each adjacent assembled combination on a support surface;

placing rebar in the cavity of each assembled combination;

pouring concrete in an uncured form over the assembled combinations and into the cavities of the forms; and allowing the concrete to cure to thereby form a concrete panel; and wherein foam pieces are removed from the foam form during the forming of the elongated slot;

wherein at least some of the wood members are removed from at least some of the elongated slots for reuse;

wherein the removing of at least some of the wood members is done by alternating removal by removing every other one of the wood members; and wherein at least some of the foam pieces are placed in the elongated slots where the wood members were removed.

2. The method of claim 1 wherein the wood member is nominal 2"×6" cross sectional shape lumber of the type available from lumber yards in the United States.

3. The method of claim 1 wherein the wood member comprises one half of a standard I-Joist of the type available from lumber yards in the United States wherein the one half of a standard I-Joists is formed from an I-Joist that is generally capital I shaped in cross sectional shape, having a central section with generally planer vertical sides, an upper section, connected approximately at the middle thereof, with a top and bottom of the upper section lying generally in horizontal planes and a lower section, the lower section being connected approximately at the middle thereof, with a top and bottom of the lower section lying generally in horizontal planes, wherein the I-Joists are cut through the approximate longitudinal center line of the central section of the I-Joist, leaving the central section of each I-Joist in two approximately same size halves.

4. The method of claim 1 wherein the forming of an elongated slot of a predetermined cross sectional shape in the first and second piers along the bottom of each of the first and second piers along the length of the first and second piers is done by using a hot wire to cut foam pieces from the foam form.

5. The method of claim 1 wherein the foam pieces are cut so as to have an elongated ridge on one side thereof when they are cut out of the foam panel and when such foam pieces are re-inserted into the elongated slots the elongated ridge is reversed so that the elongated ridge is on the other side of the respective elongated slot to cause a tighter fit into the respective elongated slot than if the foam pieces were placed back into the elongated slots in the same relationship as when the elongated pieces were cut from the foam panels.

6. The method of claim 1 wherein at least some of the wood members are secured to the foam forms before the concrete is poured.

7. The method of claim 6 wherein the wood members are attached to the foam forms with screws.

8. The method of claim 6 wherein the wood members are attached with nails driven through the foam panels and wood members at an angle with respect to vertical.

9. The method of claim 6 wherein the wood members are secured to the foam forms with an adhesive.

10. The method of claim 1 wherein a secondary slot is formed in each foam panel below the cavity.

11. The method of claim 10 wherein a piece of material that is more dense than the foam panels is placed in the secondary slot for permitting fasteners to be held in place for fastening electrical wiring thereto.

12. The method of claim 11 wherein the piece of material is wood.

13. The method of claim 12 wherein the material is fastened to the foam panels with screws and/or nails.

14. The method of claim 12 wherein the material is fastened to the foam panels with an adhesive.

15. The method of claim 12 wherein the material is a dove shaped in cross section strip of wood.

16. The method of claim 12 wherein the material is a rectangular shaped in cross section strip of wood.

17. The method of claim 11 wherein the piece of material is metal.

18. The method of claim 17 wherein the material is fastened to the foam panels with screws and/or nails.

19. The method of claim 17 wherein the material is fastened to the foam panels with an adhesive.

20. The method of claim 17 wherein the material is a C-channel of sheet metal.

21. The method of claim 1 further comprising placing an elongated foam hat on top of each one of the first and second piers to make the elongated slot deeper.

22. The method of claim 1 further comprising placing a sheet of material under the elongated foam forms after the concrete has cured.

23. The method of claim 1 further comprising attaching electrical wiring to the at least one wood member.

* * * * *